US005325544A

United States Patent [19]

Busch

[11] Patent Number: 5,325,544

[45] Date of Patent: Jul. 5, 1994

[54] TOILET FLUSH TANK AND BOWL AIR DEODORIZING APPARATUS

[76] Inventor: Michael S. Busch, 509 S. Grandview, Apt. 2, Daytona Beach, Fla. 32118

[21] Appl. No.: 982,399

[22] Filed: Nov. 27, 1992

[51] Int. Cl.[5] ..... E03D 9/052

[52] U.S. Cl. ..... 4/213

[58] Field of Search ..... 4/211, 213, 216, 348, 4/349

[56] References Cited

U.S. PATENT DOCUMENTS

| | | | |
|---|---|---|---|
| 2,591,817 | 4/1952 | Huff | 4/228 |
| 2,881,450 | 4/1959 | Tubbs | 4/213 |
| 3,230,551 | 1/1966 | Kopp | 4/213 |
| 3,626,554 | 12/1971 | Martz | 4/213 |
| 3,763,505 | 10/1973 | Zimmerman | 4/213 |
| 3,781,923 | 1/1974 | Maisch et al. | 4/213 |
| 3,887,948 | 6/1975 | Stamper | 4/213 |
| 3,900,908 | 8/1975 | Stump | 4/213 |
| 3,939,506 | 2/1976 | Pearson | 4/213 |
| 4,031,574 | 6/1977 | Werner | 4/213 |
| 4,044,408 | 8/1977 | Pearson | 4/213 |
| 4,166,298 | 9/1979 | Pearson | 4/213 |
| 5,029,346 | 7/1991 | Fernald, Sr. | 4/213 |

*Primary Examiner*—Robert M. Fetsuga
*Attorney, Agent, or Firm*—John R. Flanagan

[57] ABSTRACT

An air deodorizing apparatus for circulating and filtering air within a flush tank and bowl of a toilet includes a fan, annular air filter, and housing mounted within the toilet flush tank. The fan has a motor with a rotary output shaft and a fan blade mounted to the shaft and rotatable therewith for inducing a flow of air past the motor upon operation of the motor. The housing is mounted on an upper end of an overflow tank in the toilet flush tank. The housing supports the fan in axially aligned relation with the overflow pipe and mounts the annular air filter in concentric relation around the fan motor with the fan blade rotatable adjacent to the air flow inlet side of the annular filter. The apparatus also has an electrical power supply and switch connected to the fan motor and operable for controlling operation of the fan.

14 Claims, 3 Drawing Sheets

TOILET FLUSH TANK AND BOWL AIR DEODORIZING APPARATUS

BACKGROUND OF THE INVENTION

1. Field of the Invention

The present invention generally relates to techniques for filtering odors from air in toilets and, more particularly, is concerned with an air deodorizing apparatus for circulating and filtering within a toilet flush tank and bowl.

2. Description of the Prior Art

In the prior patent art, a wide variety of devices have been proposed for removing odors from air within a toilet flush tank and bowl. Representative examples of the prior art devices are disclosed in U.S. Pat. Nos. to Huff (2,591,817), Tubbs (2,881,450) Martz (3,626,554), Zimmerman (3,763,505), Maisch et al (3,781,923), Pearson (3,939,506), and Werner (4,031,574).

The Tubbs and Werner patents, in particular, disclose toilet tank and bowl ventilator devices mounted to the upper end of the toilet tank overflow tube. The ventilator devices include an exhaust fan driven by an electric motor and mounted in communication with the overflow tube.

The Tubbs device exhausts the air from the overflow tube to the outside atmosphere via a stand pipe or the room. A push button provided on the front exterior of the tank for operating the motor is activated by a person on the toilet seat.

The Werner device exhaust the air from the overflow tube through a filter to the interior chamber of the tank between the tank cover and the surface of the water within the tank. The fan motor is operated by a battery mounted in the interior of the tank via a clip that fits over the top lip of the tank. An activating pushbutton switch is also mounted by the clip at the exterior of the tank. The switch has a time delay which shuts off the motor, for example, three minutes after it is turned on.

The ventilator devices of the Tibbs and Werner patents appear to be steps in the right direction toward providing a satisfactory way to minimize odors in toilets. However, it is perceived by the inventor herein that further improvements are still needed in the design of a ventilator device to provide an acceptable product.

SUMMARY OF THE INVENTION

The present invention provides an air deodoring apparatus designed to satisfy the aforementioned need. The deodoring apparatus of the present invention provides a compact arrangement of a support housing, fan and air filter that reduce the amount of space occupied within the flush tank of a toilet while at the same time permits a substantially linear axial flow path for air from the overflow pipe of the toilet flush tank through the filter for achieving highly efficient operation.

Accordingly, the present invention is directed to an air deodoring apparatus for circulating and filtering air in a toilet flush tank and bowl. The deodorizing apparatus comprises: (a) a fan having a motor with a rotary output shaft and a blade mounted to the shaft and rotatable therewith for inducing a flow of air past the motor upon operation of the motor; (b) an annular air filter having opposite air flow inlet and outlet sides; (c) a housing having a lower portion capable of mounting the housing within a flush tank of a toilet and upon an upper end of an overflow pipe in the toilet tank, the housing having an upper portion with means for supporting the fan within the housing in axially aligned relation with the toilet tank overflow pipe and for mounting the annular air filter in concentric relation around the fan motor with the fan blade rotatable adjacent to the air flow inlet side of the annular filter; and (d) means connected to the motor for controlling operation of the fan.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figure 1:
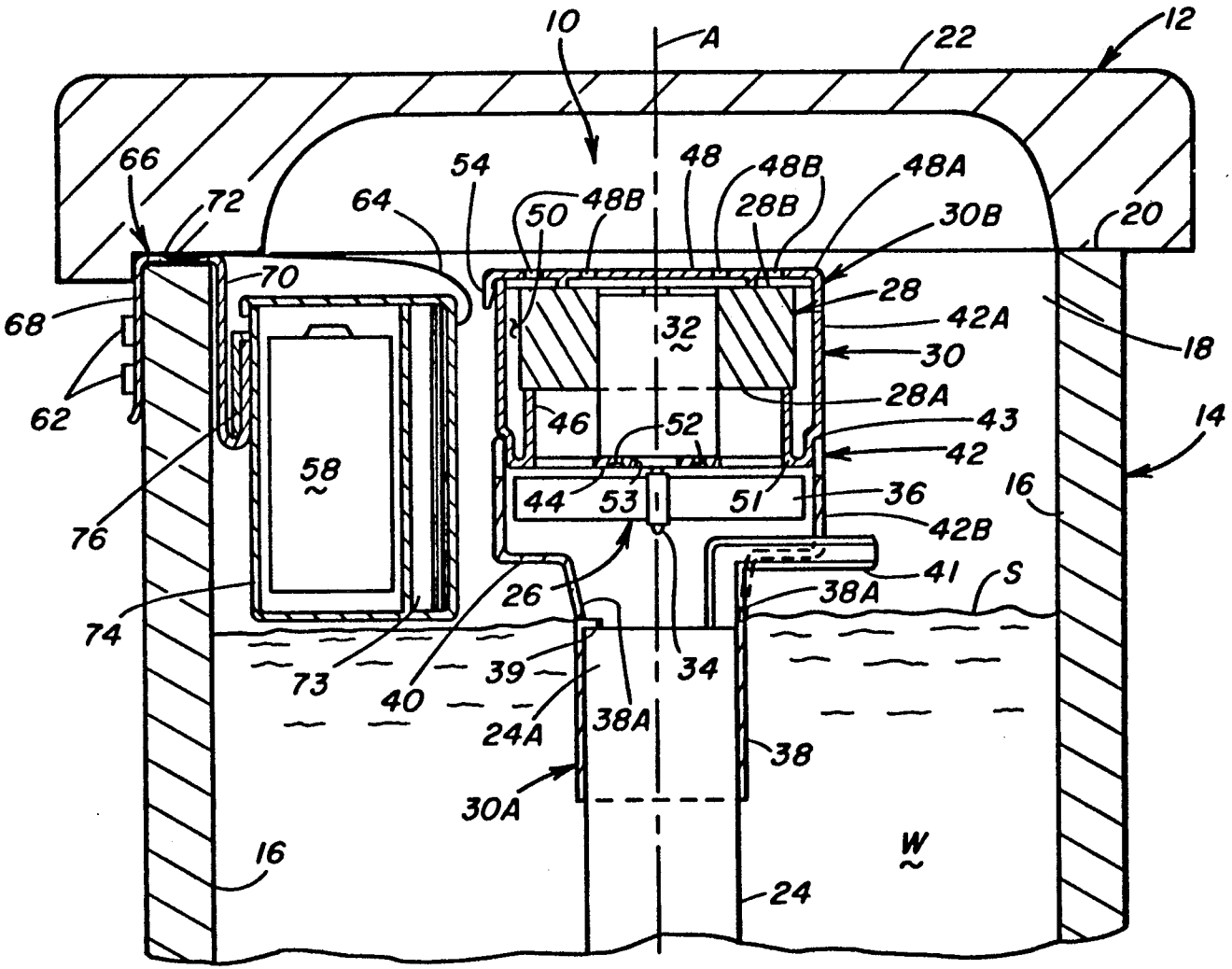
FIG. 1 is an axial sectional view of a deodorizing apparatus of the present invention mounted in a toilet flush tank.

Referring to the drawings, and particularly to FIG. 1, there is illustrated an air deodorizing apparatus of the present invention, being generally designated 10, adapted to be used in conjunction with a conventional standard toilet 12. The construction of a standard toilet 12 is well-known and thus is illustrated in FIG. 1 and described hereafter only to the extent necessary to facilitate an understanding of the present invention.

The standard toilet 12 includes a bowl (not shown) and a water-holding flush tank 14 disposed behind and above the bowl. The flush tank 14 is composed of vertical front and rear walls 16 and opposite vertical side walls 18 (only one side wall being shown) integrally connected with the front and rear walls 16 to form a top rim 20 defining an open top of the tank. A bottom wall (not shown) integrally connects the front and rear walls 16 and opposite side walls 18 to close the bottom of the tank 14.

The standard toilet 12 also includes a separate removable top cover 22 which rests on the top rim 20 of the tank 14 to close the open top thereof. Further, the standard toilet 12 includes a flushing mechanism (not shown) operable to permit release of the water from the flush tank 14 into the bowl and an overflow pipe 24 which stands upright within the flush tank 14 from its bottom wall. The overflow pipe 24 provides an open passage between the interior of the flush tank 14 and the bowl permitting overflow of water from the tank 14 into the bowl as well as refilling of the bowl with water and flow of air from the bowl to the upper interior of the flush tank 14 above the top surface S of the water W therein and below the top cover 22.

Figure 2:
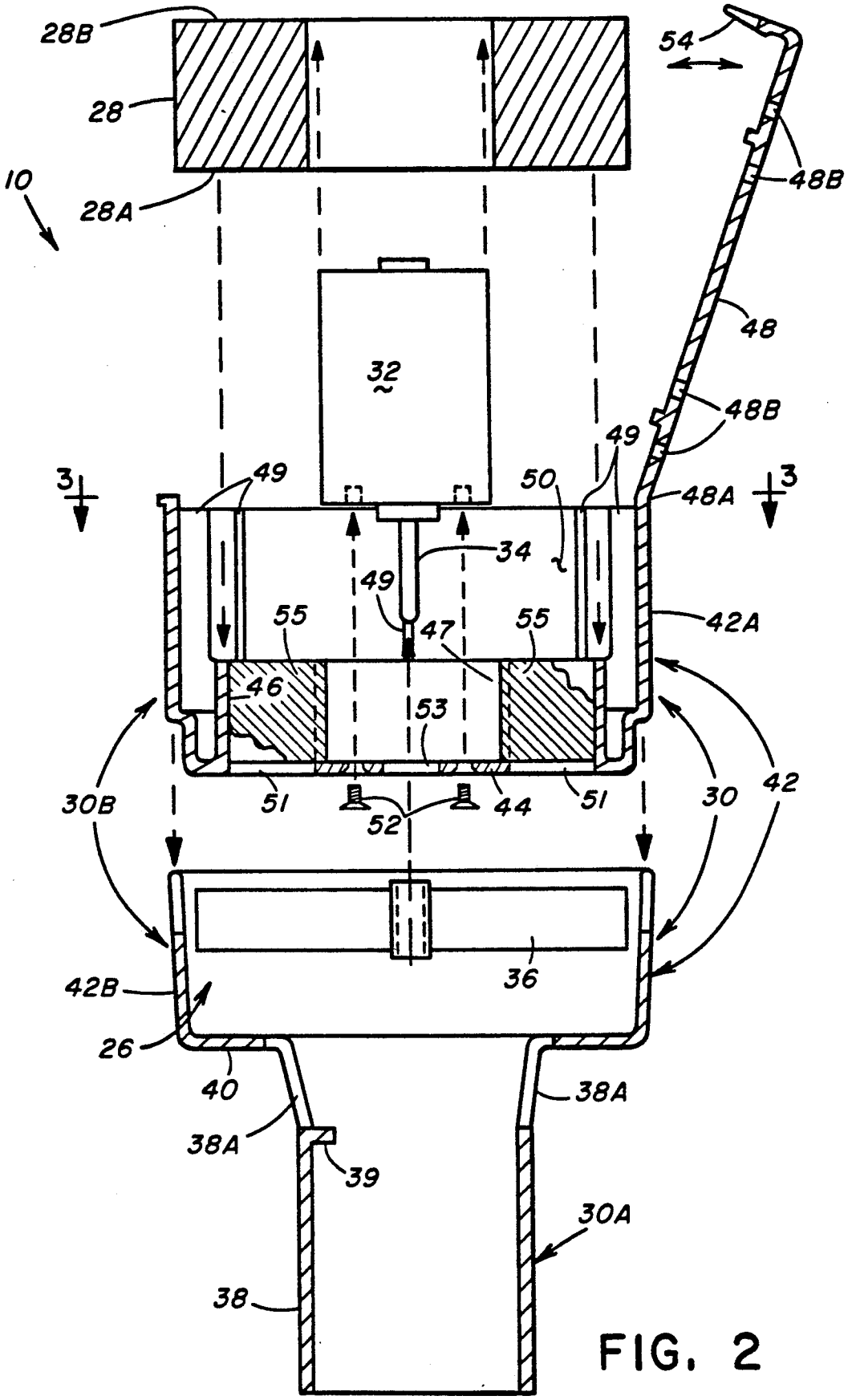
FIG. 2 is an enlarged exploded axial sectional view of a housing, fan and filter of the deodorizing apparatus.
Figure 3:
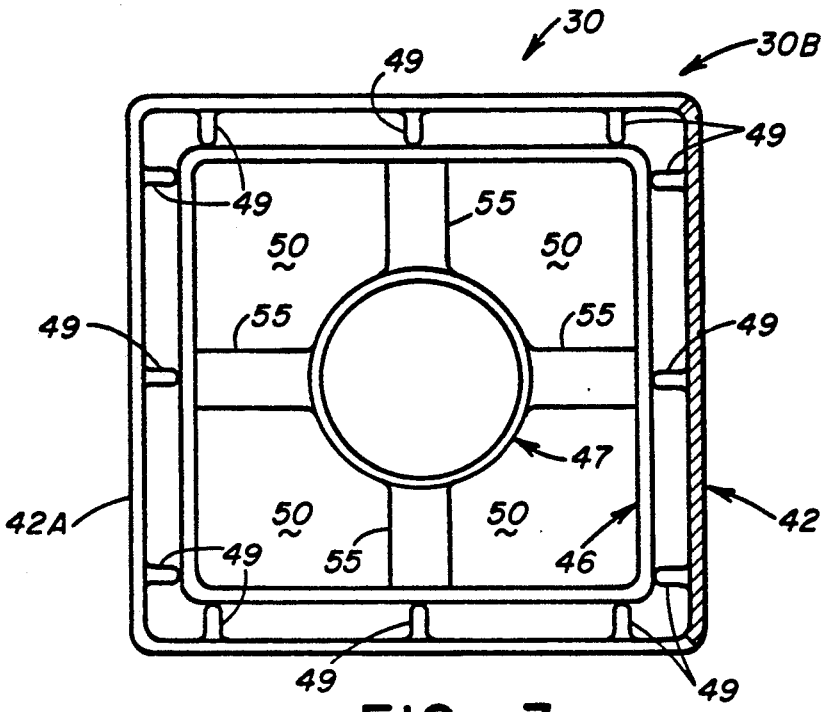
FIG. 3 is an enlarged top plan view as seen along line 3—3 of FIG. 2.

Referring to FIGS. 1–3, the air deodorizing apparatus 12 of the present invention is operable for circulating odor-laden air from the toilet bowl to the upper interior of the flush tank 14 and for filtering odors from the circulated air. In its basic components, the deodorizing apparatus 12 includes a fan 26, an annular-shaped air filter 28, and a housing 30 mounted within the toilet flush tank 14. The fan 26 includes a motor 32, preferably electric, with a rotary output shaft 34 and a fan blade 36 mounted to the end of the shaft 34 and rotatable therewith for inducing a flow of air past the motor 32 upon operation of the motor. By way of example, the air filter 28 can contain charcoal and be a commercially-available product identified as #FP55 Pollenex filter. The housing 30 can be fabricated by conventional molding techniques from a suitable plastic material.

The housing 30 of the deodorizing apparatus 10 is mounted on an upper end 24A of the overflow pipe 24 in the toilet flush tank 14. The housing 30 has a longitudinal central axis A and supports the fan motor 32 in axially aligned relation with the longitudinal central axis A of the housing and the overflow pipe 24 and mounts the annular air filter 28 in concentric relation around the longitudinal central axis A of the housing and the fan motor 32 with the fan blade 36 rotatable adjacent to the air flow inlet side 28A of the annular filter 28. In such position, the fan blade 36 is disposed between the fan motor 32 and the upper end 24A of the overflow pipe 24.

More particularly, the housing 30 is composed of lower and upper portions 30A, 30B. The lower housing portion 30A includes a tubular sleeve 38 adapted to fit over and extend upwardly from the upper end 24A of the overflow pipe 24 in the flush tank 14. An inwardly projecting tab 39 on the sleeve 38 provides a stop that engages the top edge of the overflow pipe 24 and thus provides a means to know when the sleeve 38 is fully inserted on the overflow pipe 24.

The lower housing portion 30A also has an upper annular flange 40 extending substantially perpendicular to and radially outwardly from the upper end of the tubular sleeve 38. The span of the tubular sleeve 38 above the upper end 24A of the overflow pipe 24 flares outwardly and has a plurality of slots or vents 38A therein which permit inflow of excess fill water to the overflow pipe and placement of a filler tube 41 in the overflow pipe. Also the vents 38A permit air within the tank 14 to be drawn into the housing 30 by the rotating fan blade 36 and recirculated through the filter 28.

The upper housing portion 30B includes an outer annular wall 42, a transverse wall 44, an intermediate annular wall 46, an inner annular wall 47, and a cover 48. The outer annular wall 42, which defines a chamber 50, is supported upright by the upper annular flange 40 of the lower housing portion 30A. The outer annular wall 42 has an upper annular portion 42A which at its lower edge removably nests within an upper edge of a lower annular portion 42B making a frictional interference joint 43.

The transverse wall 44 is attached to the lower edge of the upper annular portion 42A of the outer annular wall 42 and extends across the flow path of air from the overflow pipe 24 through the chamber 50 via the lower portion of the housing 30. The transverse wall 44 has openings 51 defined therein which permit passage of air flow upwardly through the chamber 50. The fan motor 32 is supported upon and attached by screws 52 to the central region of the transverse wall 44. The output shaft 34 of the fan motor 32 extends downwardly through a central opening 53 in the transverse wall 44.

The intermediate annular wall 46 and inner annular wall 47 are mounted on and extend upwardly from the transverse wall 44. The intermediate and inner walls 46, 47 are shorter in height than the outer wall 42. The intermediate annular wall 46, being spaced radially inwardly from the outer annular wall 42 and interconnected thereto by braces 49, supports the annular air filter 28 above the transverse wall 44. The inner annular wall 47 surrounds and laterally supports the fan motor 32 and is rigidly interconnected to the intermediate annular wall 46 by a plurality of radial braces 55 angularly spaced 90° from one another. The motor 32 extends upwardly through the open centers of the inner annular wall 47 and the filter 28.

The cover 48 is hingedly connected at 48A to an upper edge portion of the outer annular wall 42 and can be pivoted through an arcuate path between a closed position seen in FIG. 1 and an opened position shown in FIG. 2. A hook 54 on a portion of the cover 48 opposite from the hinge 48A is employed to releasably connect the cover 48 in the closed position to an opposite upper edge portion of the outer annular wall 42. In the closed position, the cover 48 is disposed adjacent an air flow outlet side 28B of the filter and retains the air filter 28 in place upon the inner annular wall 46 and about the motor 32. The cover 48 has openings 48B aligned with the filter 28 to permit flow of air from the chamber 50 through the cover.

Figure 4:
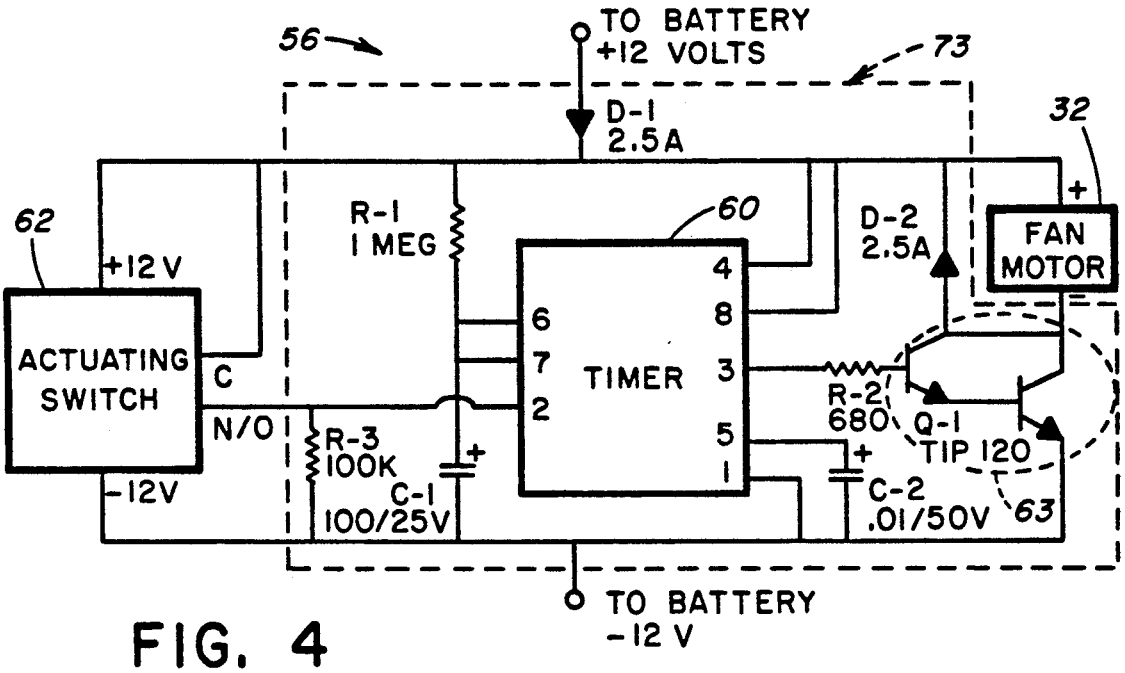
FIG. 4 is a schematic diagram of the electrical circuit of the deodorizing apparatus for controlling its operation.

Referring to FIGS. 1 and 4, the deodorizing apparatus 10 also includes controlling means in the form of an electrical circuit 56 which includes an electrical power supply 58, such as one or more D.C. batteries, a timer 60, an actuating switch 62, and an electronic on/off switch 63 connected in a series relation with one another and with the fan motor 32 by insulated conductors 64 and operable for controlling operation of the fan 26. The actuating switch 62 is actuatable by the heat radiated by the hand of a user when touching the switch 62 to close the electrical circuit 56 and activate the timer 60 which turns on the switch 63 to cause operation of the fan 26. The timer 60 is operable to turn off the switch 63 and open the electrical circuit 56 upon passage of a preset period of time, such as three minutes, after closing of the circuit 56. The power supply 58, timer 60, actuating switch 62 and electronic on/off switch of the electrical circuit 56 are all, per se conventional, commercially-available products. As examples, the timer 60 can be a NE 555 timer/oscillator. The actuating switch 62 can be an infrared heat sensor, designated SPY-007-3 by Visconic. The electronic on/off switch 63 can be a TIP 120 Darlington power transistor with a heat sink.

The deodorizing apparatus 10 further includes a bracket 66 having a pair of support members 68, 70 connected by a bight portion 72 in an inverted U-shaped configuration. The configuration of the bracket 66 permits hanging of the bracket over the top rim 20 of the flush tank 14 such that the one support member 68 is disposed on an exterior side of the tank 14 and the other support member 70 is disposed on an interior side of the tank 14. The actuating switch 62 is mounted on the one support member 68 outside of the flush tank 14, while the power supply 58 is mounted on the other support member 70 on the inside of the flush tank 14. The power supply 58 and a circuitboard 73 mounting the timer 60 and other components enclosed within the dotted box in FIG. 4 (representing the circuitboard 73) are contained in separate compartments of an air-tight container 74 and hang by a hook 76 on a side thereof from the other support member 70.

To deodorize the air in the toilet bowl, the electric fan motor 32 is turned on via actuation of the actuating switch 62. The fan blade 36 rotates with the motor shaft 34, creating a vacuum and drawing air upwardly through the housing 30 past the motor 32 from the overflow pipe 24 and from the side vents 38A. As the air passes through the filter 28 any odors carried in the air are removed. The side vents 38A further permit the air to be recirculated within the flush tank 14 back through the filter 28 for more than just a single pass. The location of the rotating fan blade 36 in FIG. 1 adjacent to the air flow inlet side 28A of the filter 28 causes the air flow to be pushed through the filter 28.

It is thought that the present invention and its advantages will be understood from the foregoing description and it will be apparent that various changes may be made thereto without departing from its spirit and scope of the invention or sacrificing all of its material advantages, the form hereinbefore described being merely preferred or exemplary embodiment thereof.

Having thus described the invention, what is claimed is:

1. An air deodorizing apparatus for use in a toilet having a bowl, a flush tank connected with and extending above the bowl for holding water to use in flushing the bowl, a top cover overlying the flush tank, and an overflow pipe disposed in the flush tank and spaced below the top cover, the overflow pipe having an upper open end providing an open passage between the bowl and the interior of the flush tank above the overflow pipe permitting passage of air between the bowl and flush tank and passage of water in the flush tank overflowing the upper open end of the overflow pipe downward through the overflow pipe into the bowl, said air deodorizing apparatus for recirculating and filtering toilet flush tank and bowl air, comprising:

(a) a fan having a fan blade being rotatable for inducing a flow of air past said fan upon operation thereof;

(b) an annular air filter having opposite air flow inlet and outlet sides;

(c) a housing capable of mounting within the flush tank of the toilet about and above the upper open end of the overflow pipe in the toilet tank between the overflow pipe and top cover of the toilet, said housing including means for supporting said fan within said housing in axially aligned relation with the toilet tank overflow pipe and for mounting said annular air filter in concentric relation around said fan with said fan blade rotatable adjacent to said air flow inlet side of said annular filter; and (d) means connected to said fan for controlling operation of said fan;

(e) said housing including (i) a lower portion having a tubular sleeve adapted to fit over the upper open end of the overflow pipe in the flush tank, and (ii) an upper portion of said housing having an outer annular wall supported by said lower portion of said housing and defining a chamber, a transverse wall extending across said outer annular wall and the flow path of air from said lower portion of said housing through said chamber of said upper portion thereof, said transverse wall supporting said motor in said chamber and having openings defined therein permitting passage of air flow upwardly through said chamber, and an intermediate annular wall mounted on and extending upwardly from said transverse wall, said intermediate wall being shorter in height than said outer wall and spaced radially inwardly therefrom, said intermediate wall supporting said annular air filter above said transverse wall.

2. The apparatus of claim 1 wherein said controlling means is an electrical circuit including a power supply and an actuating switch connected in a series relation with one another and with said fan.

3. The apparatus of claim 1 wherein said switch is an infrared heat sensor.

4. The apparatus of claim 1 wherein said electrical circuit also includes a timer connected in the series relation with said actuating switch, power supply and fan and being operable to open said electrical circuit upon passage of a preset period of time after closing of said circuit.

5. The apparatus of claim 1 further comprising:

a bracket having a pair of support members, said bracket being capable of mounting on a top rim of the flush tank such that one of said support members is disposed on an exterior side of the tank and the other of said support members is disposed on an interior side of the tank, said actuating switch being mounted on said one support member outside of said flush tank, said power supply being mounted on said other support member inside of said flush tank.

6. The apparatus of claim 1 wherein said sleeve of said housing has vents formed therethrough above the upper end of the overflow pipe and below said fan through which air from within the flush tank can be recirculated through said housing and said filter therein.

7. The apparatus of claim 1 wherein said upper housing further includes an inner annular wall mounted on and extending upwardly from said transverse wall and having substantially the same height as said intermediate annular wall, said inner annular wall being spaced inwardly from said intermediate annular wall and surrounding said motor.

8. The apparatus of claim 1 wherein said upper housing further includes a cover releasably connected to an upper edge of said outer annular wall to retain said air filter upon said intermediate annular wall, said cover having openings therein permitting flow of air from said chamber through said cover.

9. An air deodorizing apparatus for use in a toilet having a bowl, a flush tank connected with and extending above the bowl for holding water to use in flushing the bowl, a top cover overlying the flush tank, and an overflow pipe disposed in the flush tank and spaced below the top cover, the overflow pipe having an upper open end providing an open passage between the bowl and the interior of the flush tank above the overflow pipe permitting passage of air between the bowl and flush tank and passage of water in the flush tank overflowing the upper open end of the overflow pipe downward through the overflow pipe into the bowl, said air deodorizing apparatus for recirculating and filtering toilet flush tank and bowl air, comprising:

(a) a fan having a motor with a rotary output shaft and a fan blade mounted to said shaft and rotatable therewith for inducing a flow of air past said motor upon operation of said motor;

(b) an annular air filter having opposite air flow inlet and outlet sides;

(c) a housing including a lower portion having a tubular sleeve adapted to fit over the upper end of the overflow pipe in the flush tank for mounting said housing within the flush tank of the toilet about and above the upper open end of the overflow pipe in the toilet tank between the overflow pipe and top cover of the toilet, said housing also including an upper portion with means for supporting said fan within said housing in axially aligned relation with the toilet tank overflow pipe and for mounting said annular air filter in concentric relation around said fan motor with said fan blade rotatable adjacent to said air flow inlet side of said annular filter; and (d) means connected to said fan motor for controlling operation of said fan;

(e) said upper portion of said housing including (i) an outer annular wall supported by said lower portion of said housing and defining a chamber, (ii) a transverse wall extending across said outer annular wall and the flow path of air from said lower portion of said housing through said chamber of said upper portion thereof, said transverse wall supporting said motor in said chamber and having openings defined therein permitting passage of air flow upwardly through said chamber, (iii) an intermediate annular wall mounted on and extending upwardly from said transverse wall, said intermediate wall being shorter in height than said outer wall and spaced radially inwardly therefrom, said intermediate wall supporting said annular air filter above said transverse wall, (iv) an inner annular wall mounted on and extending upwardly from said transverse wall and having substantially the same height as said intermediate annular wall, said inner annular wall being spaced inwardly from said intermediate annular wall and surrounding said motor, and (v) a cover releasably connected to an upper edge of said outer annular wall to retain said air filter upon said intermediate annular wall, said cover having openings therein permitting flow of air from said chamber through said cover.

10. The apparatus of claim 9 wherein said controlling means is an electrical circuit including a power supply and an actuating switch connected in a series relation with one another and with said fan motor.

11. The apparatus of claim 9 wherein said switch is an infrared heat sensor.

12. The apparatus of claim 9 wherein said electrical circuit also includes a timer connected in the series relation with said actuating switch, power supply and fan motor and being operable to open said electrical circuit upon passage of a preset period of time after closing of said circuit.

13. The apparatus of claim 9 further comprising:

a bracket having a pair of support members, said bracket being capable of mounting on a top rim of the flush tank such that one of said support members is disposed on an exterior side of the tank and the other of said support members is disposed on an interior side of the tank, said actuating switch being mounted on said one support member outside of said flush tank, said power supply being mounted on said other support member inside of said flush tank.

14. The apparatus of claim 9 wherein said sleeve of said housing has vents formed therethrough above the upper end of the overflow pipe and below said fan through which air from within the flush tank can be recirculated through said housing and said filter therein.

* * * * *